United States Patent [19]

Van Erden et al.

[11] Patent Number: 5,026,563

[45] Date of Patent: Jun. 25, 1991

[54] ZIPPERED CLOSURE FOR THERMOFORMED PACKAGE

[75] Inventors: Donald L. Van Erden, Wildwood; Daniel P. McDonald, Arlington Heights, both of Ill.

[73] Assignee: Zip-Pak Incorporated, Northbrook, Ill.

[21] Appl. No.: 327,619

[22] Filed: Mar. 23, 1989

[51] Int. Cl.[5] ..... B65D 33/16

[52] U.S. Cl. ..... 426/122; 206/608; 206/610; 383/61; 383/63; 383/93; 383/95; 426/121; 426/123

[58] Field of Search ..... 383/61, 62, 63, 65, 383/93, 94, 95; 206/620, 630, 604, 610, 606, 608; 426/121, 122, 123, 129, 106

[56] References Cited

U.S. PATENT DOCUMENTS

| | | | |
|---|---|---|---|
| 2,546,698 | 3/1951 | Nicolle | 206/620 |
| 3,181,583 | 5/1965 | Lingenfelter | 383/94 |
| 3,473,589 | 10/1969 | Götz | 206/620 |
| 3,780,781 | 12/1973 | Uramoto | 206/620 |
| 3,827,472 | 8/1974 | Uramoto | 383/63 |
| 3,991,801 | 11/1976 | Ausnit | 383/61 |
| 4,003,184 | 1/1977 | Shiu | 426/121 |
| 4,191,230 | 3/1980 | Ausnit | 150/3 |
| 4,285,376 | 8/1981 | Ausnit | 206/620 |

FOREIGN PATENT DOCUMENTS

| | | | |
|---|---|---|---|
| 2914206 | 10/1980 | Fed. Rep. of Germany | 206/630 |

*Primary Examiner*—Donald E. Czaja
*Assistant Examiner*—D. Workman
*Attorney, Agent, or Firm*—Hill, Van Santen, Steadman & Simpson

[57] ABSTRACT

A plastic film bag for foodstuffs or the like having opposed film bag walls joined at their edges and forming a mouth between the walls at one side, reclosable fastener strips between the walls at the bag mouth having facing releasably interlocking profiles thereon with a base for each of the strips, each base web having an outer portion and an inner portion which is adjacent the contents of the bag, one inner portion bonded to the wall of the bag and the other inner portion substantially unattached, the inner portions of the webs being continuous with a perforate tear line therethrough, a sealing strip over the tear line, the outer edges of the film at the mouth bonded to each other above the fastener strips so that the outer edge can be cut leaving pull flanges with the inner portions of the base webs sealing the interior of the bag until the tear lines are torn.

5 Claims, 2 Drawing Sheets

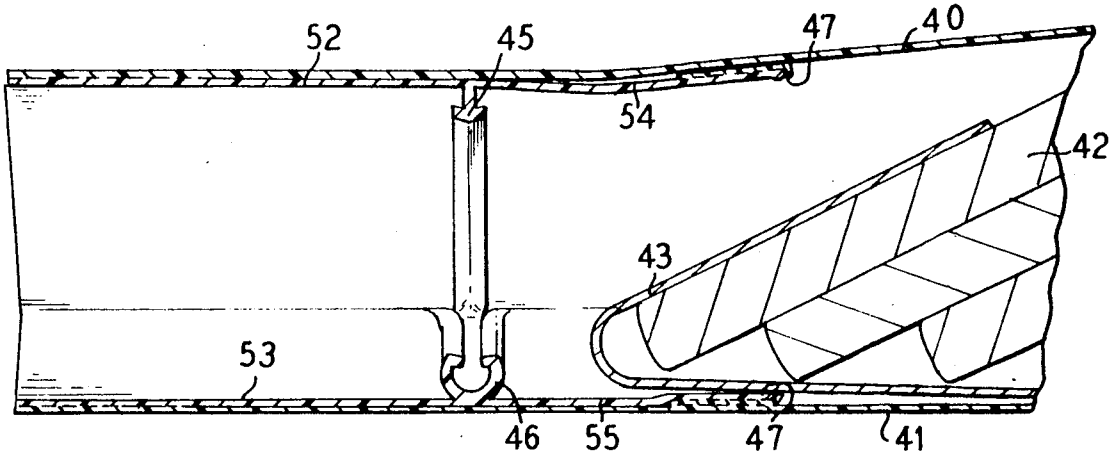
FIG. 8
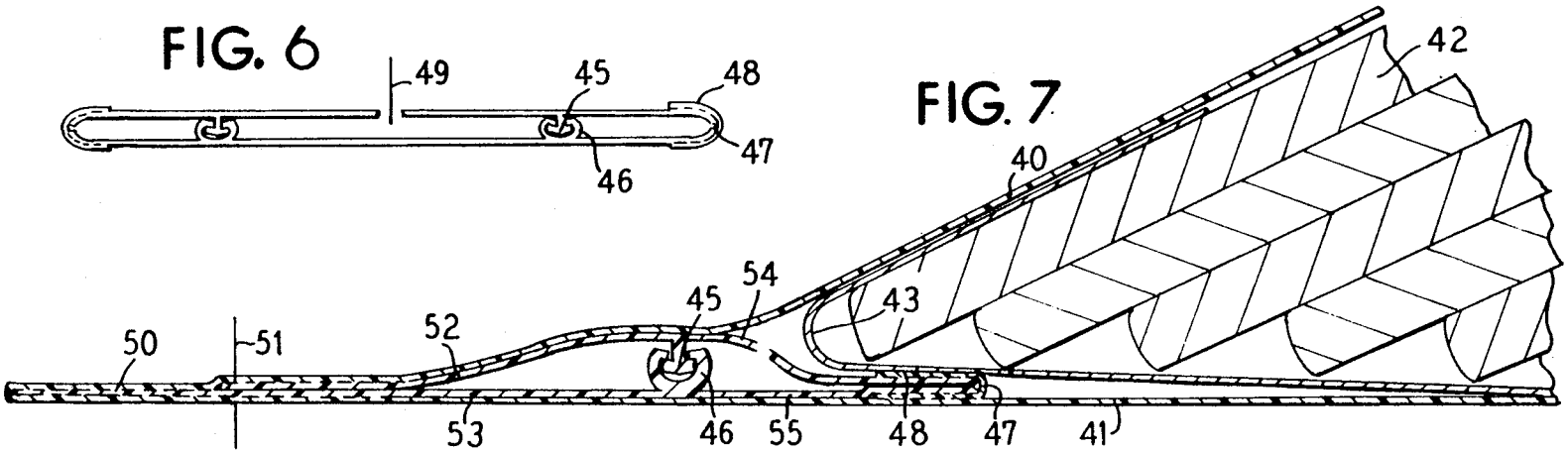
FIG. 7
FIG. 6
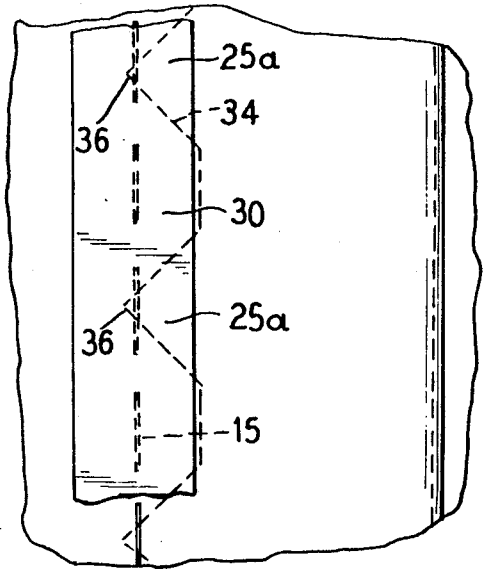
FIG. 9

ZIPPERED CLOSURE FOR THERMOFORMED PACKAGE

BACKGROUND OF THE INVENTION

This invention relates to improvements in the packaging art, and more particularly to improvements in reclosable bags.

In the provision of reclosable bags, and particularly those which are used for foodstuffs, it is desirable that a structural be used by which the bag initially fully sealed. When used for general merchandise, this prevents tampering with the contents, and when used for foodstuffs, the initial sealing protects the contents from spoilage and tampering or contamination due to intentional access to the bag or due to the entrance of air or contaminants. It is further desirable that the initial sealing be such that it is not inadvertently opened due to handling of the bag, and if opened, that there is a tamper-evident feature which would show the purchaser that the bag had been previously opened. These objectives must be accomplished without adversely affecting the reclosable feature that is used.

In some arrangements previously used, a sealing means has been provided outside of the reclosable fastener, but these allow in air space between the reclosable structure and the contents. Also, if the bag holds food items, the presence of the food can contaminate or interfere with the reclosable structure. This is particularly true where a fine rib and groove profile type of closure is used which should be kept clear of contaminants which would interfere with the interlocking of the closing structure.

It is jccordingly an object of the present invention to provide an improved flexible plastic bag structure which was a closable zipper at the mouth and which is provided with a unique sealing arrangement to prevent contamination of the foodstuffs within the container and prevent the foodstuffs from contacting the reclosable zipper.

A further object of the invention is to provide an improved fastened which is doubly sealed with sealing means outwardly of the reclosable fastener and sealing means inside of the fastener within the bag.

A still further object of the invention is to provide an improved bag and fastener structure which is particularly well suited for containing foodstuffs such as sliced meat, cheeses and other items which must be completely isolated from the outside before using.

FEATURES OF THE INVENTION

The invention utilizes a plastic film bag for containing foodstuffs such as stacked slices of bacon or meat. The plastic film bag is sealed around its edge and has a mouth along one side edge In the bag mouth is a reclosable zipper. The zipper is formed from opposed fastener strips each having a complementary rib and groove type of interlocking profile. The strips' base webs are provided with positions extending inwardly toward the foodstuffs within the bag and portions extending outwardly. The portions extending inwardly are arranged so one portion of the base web is bonded to the film wall of the bag and is continuous with the other portion so that they will provide a barrier preventing the foodstuffs from coming into contact with the zipper profile prior to use. A tangible line such as provided by perforations permits tearing of the inwardly extending base web portions as the package is initially being opened.

The base web portions which extend outwardly are unattached to provide pull flanges for opening the bag, and the film of the bag walls extends beyond the outwardly extending base web portions to seal the bag outwardly of the fastener strip profiles.

Other objects, advantages and features will become more apparent with the teaching of the principles of the invention in connection with the disclosure of the preferred embodiments thereof in the specification, claims and drawings, in which:

DESCRIPTION OF THE DRAWINGS

FIG. 6 is an elevational view similar to FIG. 2 illustrating a modified form of the fastener strips which are used;

FIG. 7 is a vertical sectional view taken through a container top using a fastener of FIG. 6;

FIG. 8 is another view of FIG. 7 showing the position of the parts as the bag is opened; and FIG. 9 is a sectional view taken substantially along line IX—IX of FIG. 4.

DESCRIPTION OF THE PREFERRED EMBODIMENTS

Figures 1, 2, 3, 4, 5:
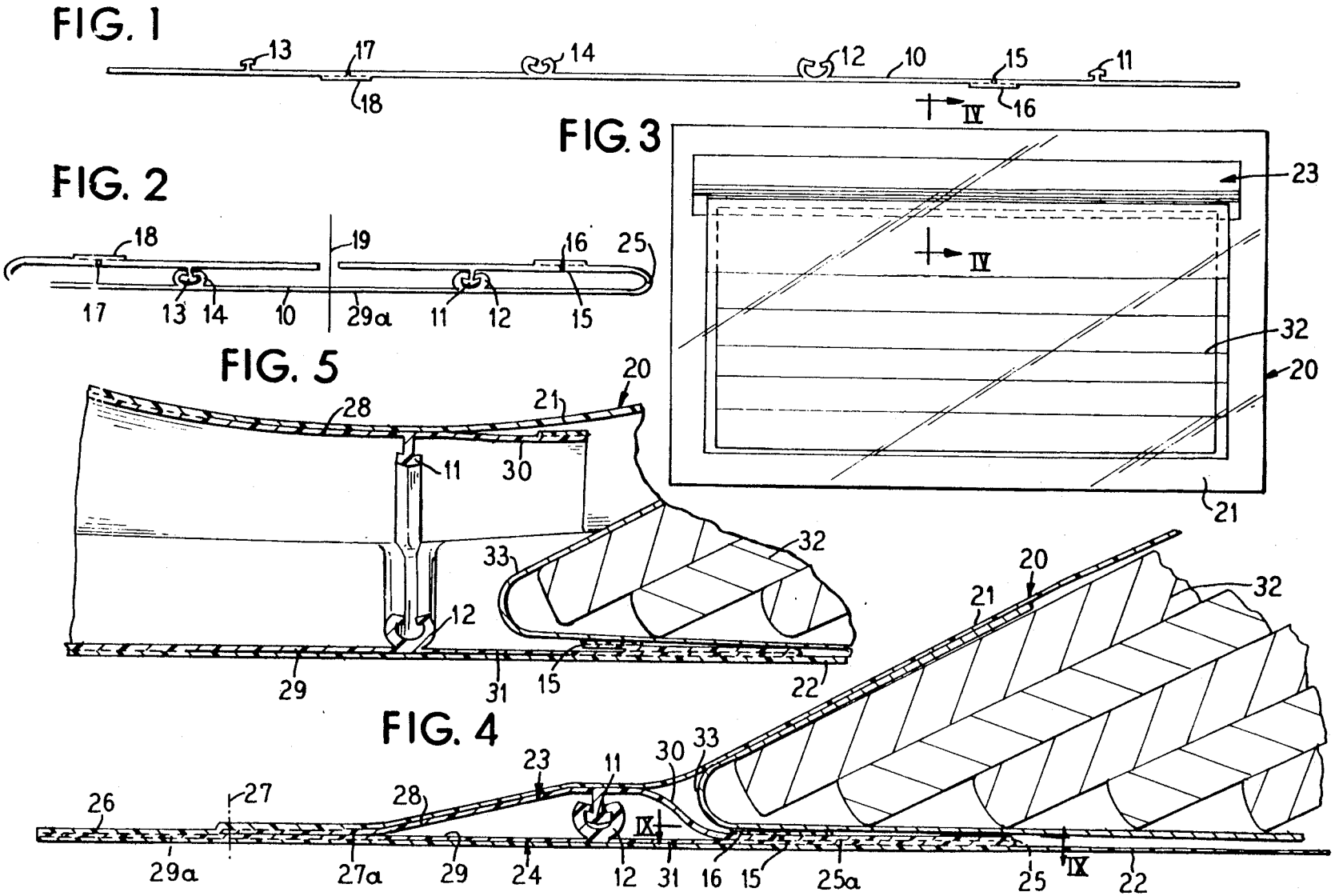
FIG. 1 is an end elevational view of a pair of connected fastener strips to be used for bag closures.
FIG. 2 illustrates the strip of FIG. 1 folded to join the interlocking profiles.
FIG. 3 is a plan view of a flexible film package with a fastener strip of FIG. 2 installed.
FIG. 4 is a sectional view taken substantially along line IV—IV.
FIG. 5 is a sectional view similar to FIG. 4 illustrating the position of the parts as the bag is being opened for the first time.

As illustrated in FIGS. 1 and 2, a dual fastener strip is provided. These are usually formed by a single extrusion process either in a tube or a flat with the strips having a backing web 10 and profiles on the surface. Male rib profile 11 is shaped and sized to interlockingly fit into female groove profile 12. A rib profile 13 is shaped and sized to fit into a groove profile 14. Additionally, frangible tear lines formed by perforations at 15 and 17 extend along the web 10 parallel to the profiles. So that leakage through the perforation lines is prevented, a protective sealing strip is adhered over the perforations as shown the strips 16 and 18. The web 10, as shown in FIG. 1, is folded bringing the profiles into interlocking relationship as shown in FIG. 2. The dual strip 13 then cut at 19, and preferably the lower web portion above the profile is slightly longer than the upper web portion as will become more clear in connection with the description of FIG. 4.

FIG. 3 illustrates a fastener strip of FIGS. 1 and 2 assembled in a package 20. The package forms a bag having a film wall 21 at one side and an opposing film wall 22 at the other side. These film walls are sealed along their edges to each other and along one side, have an opening mouth in which the fastener strip 23 is located, between the layers of film.

While FIG. 3 illustrates the fastener strip not extending to the complete sides of the film walls 21 and 22, it will be understood that in some constructions, it will be desirable that the fastener strip extend fully to the edges of the film, and the features of the invention are not to be limited by the illustration of FIG. 3.

As illustrated in FIG. 4, the bag contents, such as layers of bacon 32, are positioned between the film walls 21 and 22 and a stiffening cardboard insert 33 extends along one side of the layers of bacon providing a stiffness to the bag. The cardboard 33 will be unique to the type of foodstuffs within the bag and is useful in the case of a greasy material such as bacon to help prevent migration of the grease. However, it will be seen that the arrangement and structure of the fastener is such that the interlocking profiles 11 and 12 are protected by the location of a lower portion 30 of the web.

The thin film plastic walls extend to the edge of the bag and are heat sealed to each other at 26. As illustrated, an upper portion 29 of the fastener web extends between the layers of film and is joined thereto sandwiched by the heat seal lamination at 26.

The fastener strips 23 and 24 can be, for the purpose of reference, described as upper and lower strips, but their relative location is either at the top or along one side of the bag, and the location is not material to their function. The upper strip 23 has a base web for the profile with an outer portion 28 which extends outwardly from the rib, away from the bag contents. The other strip 24 has an outer portion 29 of the base web which extends from the groove outwardly away from the contents. The upper strip 23 has an inner web portion 30 extending inwardly toward the contents. The strip 24 has an inner portion 31 which extends inwardly in the bag toward the contents. The inner portions 30 and 31 are integral with each other forming a fold at 25.

The strips in their location in the mouth of the bag are laminated to the inner surfaces of the film layers 21 and 22. The lower strip 24 is laminated over its full length so that the outer portion 29 and the inner portion are both laminated over their full surface.

The upper strip 23, however, is laminated only over the outer portion 28, which lamination extends to the location below the rib 11. The inner portion 30, however, is free of lamination to the film 21 and extends downwardly beneath the bacon 32 to lay along the inner web 31. The webs are laminated to each other over the area 25*a* extending from the fold 25 to the perforations 15. The web 30, however, is free of lamination to the web 31 between the perforations 15 and the profiles 11 and 12.

The bag contents are fully sealed from contaminants in the store until the purchaser buys the bag 20 and first opens it. A triple seal prevents the passage of air between the atmosphere and the bag contents 32. First, the laminated film at 26 provides a barrier. Next, the joined rib and groove 11 and 12 provide a barrier. Further, the base strip portions 30 and 31 are connected to each other at 25 to provide a barrier and the perforations are sealed by the strip 16.

In use, after the purchaser buys the package, the package is opened by cutting off the top along the cut line 27. This permits the separation of the outer portions 28 and 29 of the base strips, which are not bonded to each other at 27*a*. After the top is cut off along 27, the outer portions 28 and 29 provide pull flanges as shown in FIG. 5. Pulling the pull flanges apart, separates the rib and grooves profiles 11 and 12 as shown in FIG. 5. Continued pulling of the pull flanges tears the perforation line 15 so that the remaining portion of the inner base strip 30 lifts upwardly as illustrated in FIG. 5.

To tear the perforation line 15 often requires substantial pull on the flanges, and tearing can be aided by the user inserting his fingers into the space between the strip portions 30 and 31. This still may cause difficultly in tearing the tear line, and for this purpose, areas of stress concentration are provided along the tear line 15. One manner of providing the area of stress concentration is shown in FIG. 4 and in detail in FIG. 9 wherein the bond 25*a* is terminated in an undulating line 34. This leaves the areas 30 free to separate and provides points 36 of stress concentration. When the user inserts his finger between the layers 30 and 31, the tear line 15 will tend to start separating at the points 36 of stress concentration. This arrangement which aids in separating the tear line 15 has been found to be particularly useful where the tear line is located in the surface of the inner web portion 30.

FIGS. 6 through 8 are provided to show another manner of construction wherein the tear line is provided at the exact location of the fold.

As shown in FIG. 6, a double fastener strip is provided having a rib profile 45 and a groove profile 46. A tear line is provided in the strip at 47 covered by a sealing layer 48. The double closure strip is severed along a cut line 49.

The sealing strip, thus severed, is attached in the mouth of a bag in FIGS. 7 and 8 with the bag formed of film walls 40 and 41. The fastener strip has outer strip portions 52 and 53 which extend from the profiles away from the bag, and inner strip portions 54 and 55 which extend from the profiles toward the bag contents. The bag contents are shown as layers of meat or bacon 42 with a folded cardboard over one edge adjacent the closure strip.

The film layers are extended and bonded to each other at 50 along the top and the longer outer flange 53 may extend between the layers and be bonded therebetween.

The fastener strips are laminated to the film layers with the lower strip bonded over its full length to bond both the outer strip portion 53 and inner strip portion 55.

The upper strip, however, is bonded over only the outer strip portion to the base of the rib 45 with the inner strip portion 54 unbonded to the film and extending down beneath the edge of the contents to be continuous with the inner strip portion 55 and the strips are folded at the location of the tear line 47.

In use, the purchaser finds a package fully sealed by the outer seal 50 between the film layers. The intermediate seal is provided by the interlocked rib and groove 45 and 46, and an inner seal is provided by the continuous inner strip portions 54 and 55 with the perforations protected by the sealing layer 48.

In use, the purchaser cuts off the top along a cut line 51 so that the outer strip portions 52 and 53 separate and form pull flanges. Pulling these flanges apart in the manner shown in FIG. 8, separates the rib 45 from the groove 46, and continued pull causes the inner strip portions 54 and 55 to tear apart along the tear line 47, thus permitting removal of the bacon 42 from within the package. The inner web portion 54 conveniently lays along the film 40 out of the way of the contents as they are removed or put back in the package. The package is, of course, reusable and the contents can be reinserted and the rib and groove profile 45 and 46 rejoined.

Thus, there has been provided a reclosable package, yet one which is completely sealed against contaminants. The structure is particularly well suited for use with foodstuffs and provides a seal, but with the convenience of a reusable reclosable package.

We claim as our invention:

1. A plastic film bag for foodstuffs or the like, comprising in combination:

a first plastic film bag wall joined at its edge to a second plastic film bag wall with a bag mouth between the walls at one side;

reclosable fastener strips between the walls at the bag mouth having facing releasably interlocking profiles thereon each with a base web bonded to the confronting surfaces of the film, each base web having an inner portion between the profiles and the bag interior and an outer portion outwardly of the profiles;

the inner portion of said base webs being continuous with each other to seal the bag interior;

frangible tear means on the inner portion of the base webs for breaking into the bag interior so that the profiles can be separated and thereafter afford a reclosable bag mouth; and said frangible tear means being in the form of a perforation line through the base webs with the bond line following an undulating path to define points of stress concentration for tearing the perforation line.

2. The method of making a flexible plastic container for foodstuffs of the like comprising the steps:

forming opposed plastic film walls for defining a bag with a mouth at one edge;

forming reclosable fastener strips with base webs and confronting pressure closable ropenable profiles thereon, the webs having an inner portion at one side of the profiles adjacent the bag interior and an outer portion at the other side of the profile, said inner portions joined to each other;

surface bonding the strips between the film walls;

forming a frangible tear line between the inner portions of the base webs;

forming a perforation through the joined inner portions of the webs; said perforations being formed at a folded edge between said inner portions of the base webs; and the band line being formed in an undulating pattern to provide stress concentration locations for tearing the perforation.

3. A plastic film bag for foodstuffs or the like, comprising in combination:

a first plastic film bag wall joined at its edge to a second plastic film bag wall with a bag mouth between the walls at one side;

reclosable fastener strips between the walls at the bag mouth having facing releasably interlocking profiles thereon each with a base web bonded to the confronting surfaces of the film, each base web having an inner portion between the profiles and the bag interior and an outer portion outwardly of the profiles;

the inner portion of said base webs being continuous with each other to seal the bag interior; and frangible tear means in the form of a perforation line on the inner portion of said base webs with a bond line following an undulating path to define points of stress concentration through the perforation line for breaking into the bag interior so that the profiles can be separated and thereafter afford a reclosable bag mouth.

4. The method of making a flexible plastic container for foodstuffs or the like, comprising the steps;

forming opposed plastic film walls for defining a bag with a mouth at one edge;

forming reclosable fastener strips with base webs and confronting pressure closable reopenable profiles thereon, the webs having an inner portion at one side of the profiles adjacent the bag interior and an outer portion at the other side of the profile, said inner portions joined to each other;

surface bonding the strips between the film walls; and forming a frangible tear line between the inner portions of the base webs including an undulating bond line at the tear line to provide stress concentration locations for tearing the perforations.

5. A plastic bag for foodstuffs or the like, comprising in combination:

opposed bag film walls having a bag mouth along one side;

reclosable fastener strips having confronting pressure closable and reclosable profiles, the strips being bonded to the inner surface of the film walls at the bag mouth; and a frangible member joining the strips inwardly of the profiles adjacent the bag interior with the frangible member sealing the bag interior until broken and after which the bag is opened and reclosed by the profiles, said frangible member having a tear line and a bond line arranged in a zig-zag pattern to form areas of stress concentration for tearing the tear line.

* * * * *